US009272399B2

(12) United States Patent
Chen et al.

(10) Patent No.: US 9,272,399 B2
(45) Date of Patent: Mar. 1, 2016

(54) ELECTRICAL WRENCH

(71) Applicant: CHERVON (HK) LIMITED, Wanchai (HK)

(72) Inventors: Liang Chen, Nanjing (CN); Qiwei Zhou, Nanjing (CN)

(73) Assignee: CHERVON (HK) LIMITED, Wanchai (HK)

( * ) Notice: Subject to any disclaimer, the term of this patent is extended or adjusted under 35 U.S.C. 154(b) by 264 days.

(21) Appl. No.: 14/096,185

(22) Filed: Dec. 4, 2013

(65) Prior Publication Data

US 2014/0165788 A1 Jun. 19, 2014

(30) Foreign Application Priority Data

Dec. 14, 2012 (CN) ..... 2012 1 0544418

(51) Int. Cl.
*B25B 21/00* (2006.01)

(52) U.S. Cl.
CPC ..... *B25B 21/004* (2013.01)

(58) Field of Classification Search
CPC .... B25B 21/002; B25B 21/004; B25B 13/463
USPC ..... 81/57.11, 57.13
See application file for complete search history.

(56) References Cited

U.S. PATENT DOCUMENTS

| | | | | | |
|---|---|---|---|---|---|
| 3,886,822 | A * | 6/1975 | Pauley | B25B 21/00 | 173/52 |
| 3,960,035 | A * | 6/1976 | Workman, Jr. | B25B 21/002 | 173/178 |
| 3,965,778 | A * | 6/1976 | Aspers | B25B 21/002 | 173/177 |
| 4,064,772 | A * | 12/1977 | Boyd | B25B 21/002 | 81/57.13 |
| 4,403,532 | A * | 9/1983 | Wallace | B25B 23/145 | 81/483 |
| 4,729,260 | A * | 3/1988 | Dudden | F16H 59/16 | 173/216 |
| 4,898,248 | A * | 2/1990 | Thompson | B25B 21/00 | 173/177 |
| 5,636,698 | A * | 6/1997 | Estep | B25B 21/00 | 173/176 |
| 2012/0103142 | A1* | 5/2012 | Sroka | B25B 13/48 | 81/57.11 |
| 2014/0209322 | A1* | 7/2014 | Francis | B23P 19/069 | 166/377 |

* cited by examiner

*Primary Examiner* — David B Thomas
(74) *Attorney, Agent, or Firm* — Greenberg Traurig, LLP

(57) ABSTRACT

An electrical wrench includes a motor, a transmission mechanism, a ratchet assembly and a controlling member coupled to each other. The transmission mechanism is configured to provide idle travels. The ratchet assembly receives the rotating torque output by the transmission mechanism and drives the ratchet therein in a single direction. The controlling member is connected with the motor and controls the motor to rotate in the opposite direction when detecting the motor is stalled. The electrical wrench thus provides impacting action by electrical control and simplifies the mechanical structure of the tool, which not only reduces the manufacturing cost, but also prolongs the working life of the tool.

10 Claims, 5 Drawing Sheets

ELECTRICAL WRENCH

RELATED APPLICATION INFORMATION

This application claims the benefit of CN 201210544418.X, filed on Dec. 14, 2012, the disclosure of which is incorporated herein by reference in its entirety.

FIELD

The subject disclosure generally relates to electrical tools and, more particularly, to an electrical wrench.

BACKGROUND

Electrical tools are presently being used in industrial manufacture and maintenance instead of manual tools. For example, an electrical wrench is used to fasten work pieces such as bolts or nuts. Sometimes during operation, a work piece can be locked when the electrical wrench tightens the work piece in an positive direction but it cannot be disassembled when the electrical wrench releases the work piece in a negative direction. The reason is that, when the electrical wrench is used to tighten the work piece, the output is changed from a high-speed state to stop state and thus a relatively large impacting torque is generated so as to tighten the work piece; but, when disassembling the work piece, the output is in a stalled state at the beginning, and the starting torque is relatively small, thus it is difficult to twist the work piece free.

At present, in order to resolve the above problem, a mechanical impacting assembly is added to the electrical wrench. The conventional impacting assembly comprises a hammer and an anvil, wherein the hammer is supported onto a spindle by a rolling ball arranged in a groove, and the anvil is driven by convex portions correspondingly arranged on the hammer and the anvil for generating an output. When the rotation of the anvil is blocked by resistance, the hammer will move axially backwards relative to the spindle against an elastic member arranged on the rear end of the hammer, and then the convex portions on the hammer and the anvil are staggered and restored rotatably under the biasing action of the elastic member, thus the convex portions on the hammer and the anvil come into contact again and an impacting action is generated. If the rotation of the anvil is blocked by resistance continuously, the above process is repeated so as to perform a continuous impacting action.

Arranging a mechanical impacting assembly in an electrical wrench may add to the number of members required in manufacture. Moreover, due to the continuous impacting action, there are high requirements for the mechanical accuracy and strength of the members. Thus, the electrical wrench provided with the mechanical impacting assembly greatly increases the manufacturing cost. In addition, the mechanical assembly may cause mechanical wear and damage on the device, thus the impacting efficiency will be decreased after a long time of operation and even the failure of the impacting action can occurred, thereby reducing the working life of the electrical wrench.

SUMMARY

Thus, to overcome these deficiencies, disclosed hereinafter is an electrical wrench that generates a relatively large staring torque while having a relatively low cost and relatively long working life.

To this end, the subject electrical wrench comprises: a motor, a transmission mechanism, a ratchet assembly and a controlling member; the motor, the transmission mechanism and the ratchet assembly being connected with each other; the transmission mechanism comprising a first transmission member and a second transmission member rotatably connected with each other; the ratchet assembly comprising an eccentric shaft, a swinging member, a pawl and a ratchet, the eccentric shaft being provided with a shaft projection deviated from the axis thereof, the swinging member being configured to swing along with the rotation of the eccentric shaft and having an accommodating portion for accommodating the shaft projection, the pawl being arranged on the swinging member and contacting ratchet teeth on the outer circumference of the ratchet, and the pawl being configured to drive the ratchet to rotate in a single direction along with the swinging of the swinging member; the controlling member being arranged to control the rotation of the motor; the first transmission member and the second transmission member being provided with idle travels separated from each other in the rotating direction, and the controlling member comprising a detecting module for detecting whether the motor is stalled and a controlling module for controlling the motor to rotate in an opposite direction when detecting the motor is stalled.

Further, the controlling module may be provided with a parameter threshold indicating the stalling of the motor with the detecting module detecting a corresponding working parameter of the electrical wrench and sending it to the controlling module, wherein the controlling module can detect the stalling of the motor and control the motor to rotate in the opposite direction by comparing the working parameter with the parameter threshold.

In some circumstances, the parameter threshold is a current threshold and the working parameter is a working current. The detecting module is used to detect the working current flowing through the motor and send it to the controlling module, and the controlling module compares the working current with the current threshold and controls the motor to rotate in the opposite direction when the working current is equal to or larger than the current threshold.

In some circumstances, the parameter threshold is a rotating speed threshold and the working parameter is a working rotating speed. The detecting module is used to detect the working rotating speed of the transmission mechanism and send it to the controlling module, and the controlling module compares the working rotating speed with the rotating speed threshold and controls the motor to rotate in the opposite direction when the working rotating speed is equal to or lower than the rotating speed threshold.

In the subject electrical wrench, the first and second transmission members are rotatably connected with each other and have idle travels separated from each other in the rotating direction. When the stalling of the motor is detected, the controlling member controls the motor to rotate in the opposite direction, and the motor drives the transmission mechanism in the opposite direction so as to generate an impact action. Moreover, due to the single-direction driving performance of the ratchet assembly, the impacting torque and the rotating torque are still loaded in the selected rotating direction of the ratchet assembly, thereby generating a relatively large starting torque. In addition, the subject electrical wrench does not need a complex mechanical impacting assembly and can perform the function of the conventional impacting wrench only by electronic control. In this manner, the subject electrical wrench can greatly reduce the manufacturing cost of the tool and enhance the economic benefit and, due to the electronic control, the mechanical structure of the tool is simplified, which greatly reduces the mechanical wear and damage caused by the complex structure, thereby prolonging the working life of the tool.

DETAILED DESCRIPTION OF THE PREFERRED EMBODIMENTS

The following will describe preferred embodiments of an electrical wrench with reference to the drawings.

Figure 1:
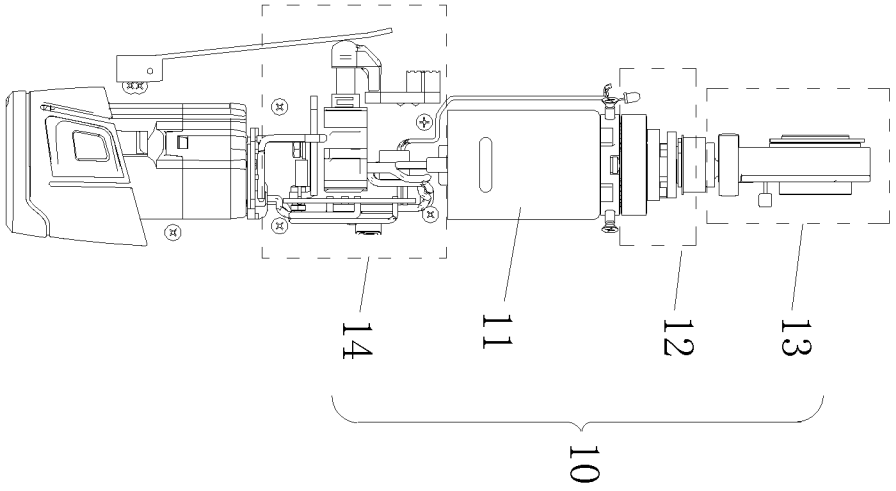
FIG. 1 is a structural view of an exemplary electrical wrench constructed according to the description that follows.

Referring to FIG. 1, the electrical wrench 10 comprises a motor 11, a transmission mechanism 12, a ratchet assembly 13 and a controlling member 14. The motor 11, the transmission mechanism 12 and the ratchet assembly 13 are connected to each other, and the transmission mechanism 12 receives the rotating torque output by the motor 11 and then transmits it to the ratchet assembly 13.

Figure 2:
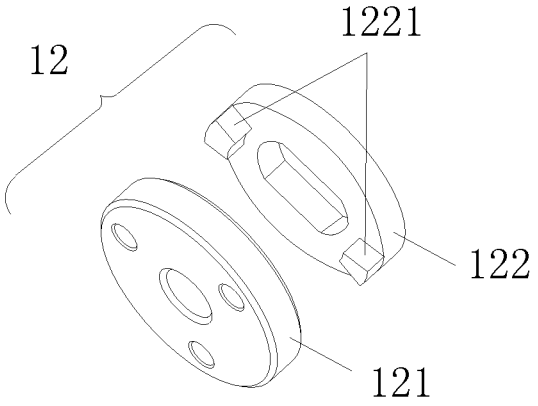
FIG. 2 is a structural view of an exemplary transmission mechanism of the electrical wrench of FIG. 1.

Referring to FIG. 2, the transmission mechanism 12 comprises a first transmission member 121 and a second transmission member 122. In the illustrated embodiment, the first transmission member 121 has a circular plate shape with an opening in the central portion for receiving the rotating torque output by the motor 11. The second transmission member 122 has a circular plate shape with a flat opening in the central portion for connecting the ratchet assembly 13 and for outputting the rotating torque. The first transmission member 121 and the second transmission member 122 are adjacent to each other, rotatably connected with each other, and have idle travels separated from each other in the rotating direction. It may be appreciated that the transmission mechanism 12 is not limited to the illustrated embodiment, and may also be implemented by other means which would be appreciated by a person skilled in the art given this disclosure. For example, the first and second transmission members may also be rectangular in shape with two arc-shaped ends.

The first transmission member 121 and the second transmission member 122 have idle travel in the rotating direction. If the motor is started, the mechanical member of the transmission mechanism of the tool may transmit the rotating torque of the motor to the acting portion of the tool in a direct contacting manner (omitting the tolerance of the members), wherein the torque transmission process does not have idle travel. In idle travel the mechanical components of the transmission mechanism have separated space travels. When the motor is started, the mechanical components may move a certain space in travel for an idle operation, and then contact with each other so as to transmit the torque. Due to the inertia accumulated by the mechanical components of the transmission mechanism during the idle operation, the instant torque caused by the contact may be larger than the rotating torque outputted by the motor. Thus, it will be understood that the idle travel in the mechanical structure is generally designed to increase the initial kinetic energy or generate an impact action.

Figure 3:
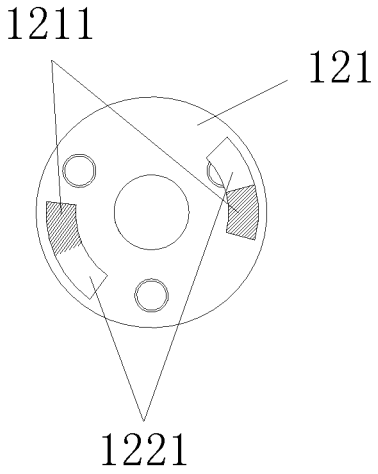
FIG. 3 is a sectional view illustrating an exemplary connection between the first and second transmission members of the transmission mechanism of the electrical wrench of FIG. 1.

Referring to FIG. 3, the end surface of the first transmission member 121 facing the second transmission member 122 is symmetrically provided with a pair of first bosses 1211 in the radial direction. The end surface of the second transmission member 122 facing the first transmission member 121 is correspondingly provided with a pair of second bosses 1221 by the same radial distance. The first transmission member 121 and the second transmission member 122 are adjacent to each other and can rotate coaxially. When rotating a certain angle, the first bosses 1211 contact the second bosses 1221 so that the first transmission member 121 may transmit the rotating torque to the second transmission member 122. Due to the symmetrical arrangement of the bosses, the rotating angle is slightly smaller than 180°.

Figure 4:
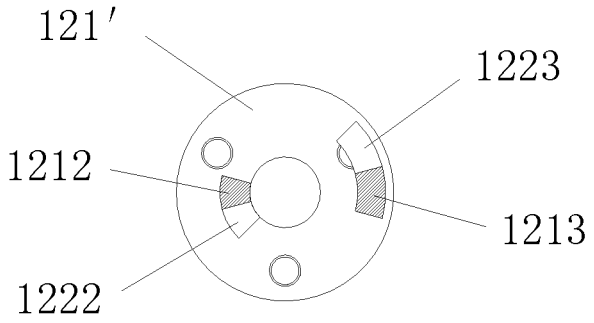
FIG. 4 is a sectional view illustrating a further exemplary connection between the first and second transmission members of the transmission mechanism of the electrical wrench of FIG. 1.

Referring to FIG. 4, in another embodiment, the difference mainly lies in the implementation of the idle travel, and the difference in structure mainly lies in the connection between the first transmission member 121' and the second transmission member. The end surface of the first transmission member 121' facing the second transmission member is asymmetrically provided with a first boss 1212 and a second boss 1213 in the radial direction. That is to say, the first boss 1212 and the second boss 1213 have different radial distances from the centre of the end surface. The end surface of the second transmission member facing the first transmission member 121' is correspondingly provided with a third boss 1222 and a fourth boss 1223. The first transmission member 121' and the second transmission member are adjacent to each other and can rotate coaxially. When rotating an angle, the first boss 1212 contacts the third boss 1222 through the fourth boss 1223, and the second boss 1213 contacts the fourth boss 1223 through the third boss 1222, thus the first transmission member 121' may transmit the rotating torque to the second transmission member. Due to the asymmetrical arrangement of the bosses, the rotating angle is larger than 180° and slightly smaller than 360°. This arrangement may increase the space travel between the members, facilitating the accumulation of inertia and generating a larger instant torque when the members come into contact.

With the same output of the motor, reducing the rotating speed of the transmission mechanism can increase the torque output thereof, thus the transmission mechanism may further comprise a gear speed-reducing member. The gear speed-reducing member is arranged between the first transmission member 121 and the motor 11 for reducing the rotating speed output by the motor 11. The gear speed-reducing member may be a planet gear speed-reducing mechanism or multi-stage gear speed-reducing mechanism. In order to make the structure of the mechanical components more compact, the subject device may use a planet gear speed-reducing mechanism.

The ratchet assembly has a function of single-direction output. When the rotating direction of the ratchet of the ratchet assembly is determined, the ratchet will always rotate in the determined direction if the ratchet assembly receives a positive rotation transmission or a negative rotation transmission. The following will describe the ratchet assembly 13 of the electrical wrench 10 of the illustrated device.

Figure 5:
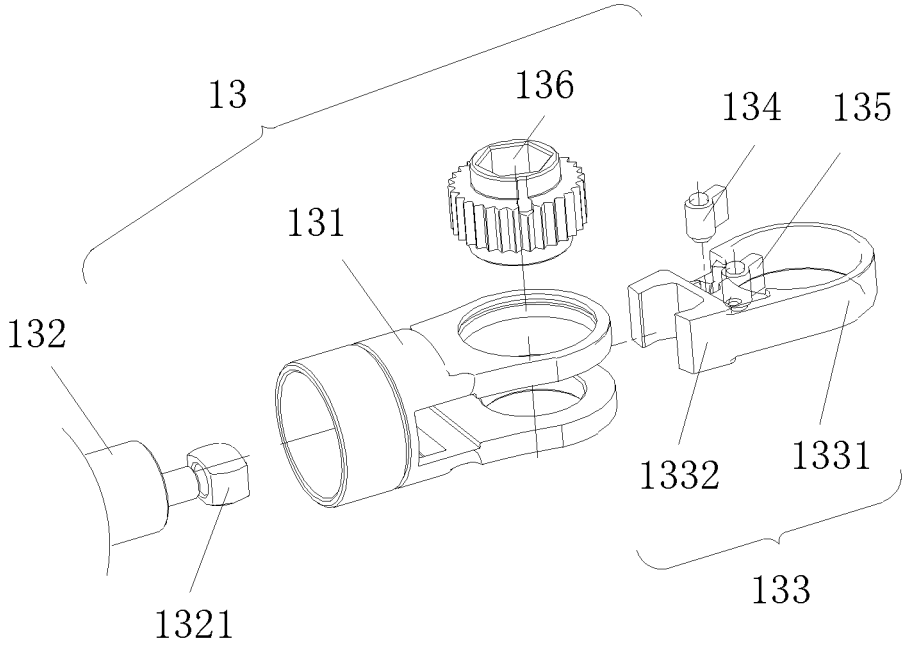
FIG. 5 is a structural view of an exemplary ratchet assembly of the electrical wrench of FIG. 1.

Referring to FIG. 5, the ratchet assembly 13 comprises a bracket 131, an eccentric shaft 132, a swinging member 133, a first pawl 134, a second pawl 135 and a ratchet 136. The eccentric shaft 132, the swinging member 133, the first pawl 134, the second pawl 135 and the ratchet 136 are accommodated in the bracket 131. One end of the eccentric shaft 132 is connected with the power output end of the transmission mechanism 12, and the end surface of the other end is provided with a shaft projection 1321 deviated from the axis of the eccentric shaft 132. The eccentric shaft 132 receives the torque transmitted by the transmission mechanism 12 and can rotate in the bracket 131. The swinging member 133 comprises a mating portion 1331 and an accommodating portion 1332. The mating portion 1331 is generally O-shaped, and arranged on the outer circumference of the ratchet 136. The accommodating portion 1332 is generally U-shaped, and the shaft projection 1321 of the eccentric shaft 132 is accommodated in the accommodating portion 1332. The swinging member 133 is fixed in the bracket 131 and can swing around the ratchet 136. When the eccentric shaft 132 rotates, the shaft projection 1321 forces the accommodating portion 1332 so that the swinging member 133 swings around the ratchet 136. The pawls 134, 135 are arranged on the swinging member 133 by springs, and selectively contact the ratchet 136. If the first pawl 134 is in contact with the ratchet 136, when the swinging member 133 swings in the clockwise direction, the first pawl 134 forces the ratchet 136 to rotate in the clockwise direction, and when the swinging member 133 swings in the anticlockwise direction, the first pawl 134 slips over the ratchet teeth on the outer circumference of the ratchet 136. If the second pawl 135 is in contact with the ratchet 136, when the swinging member 133 swings in the clockwise direction, the second pawl 135 slips over the ratchet teeth on the outer circumference of the ratchet 136, and when the swinging member 133 swings in the anticlockwise direction, the second pawl 135 forces the ratchet 136 to rotate in the anticlockwise direction. It may be appreciated that the ratchet assembly is not limited to the above embodiment, and may include other variants that would be appreciated by one of skill in the art given the disclosure herein.

Figure 6:
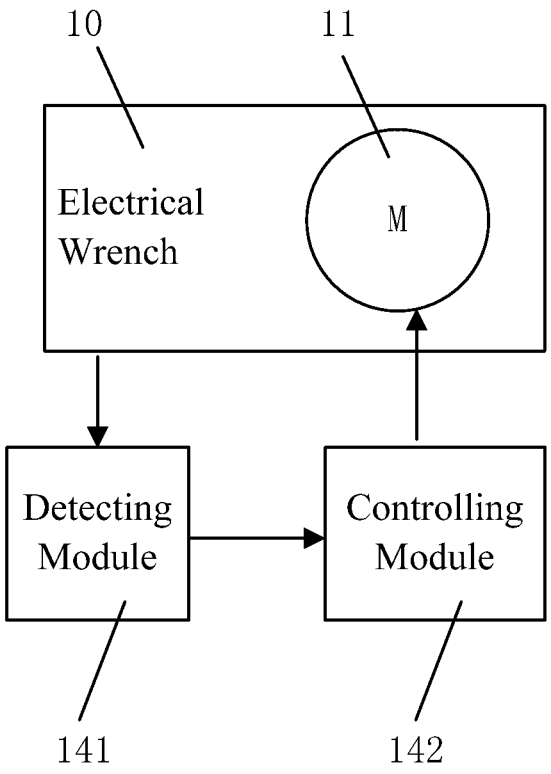
FIG. 6 is a block diagram of an exemplary controlling member of the electrical wrench of FIG. 1.

The controlling member 14 drives the electrical wrench 10 having the transmission mechanism 12 and the ratchet assembly 13 to generate an impacting action by electronic control. The controlling member 14 is connected with the motor 11, and controls the motor 11 to rotate in the opposite direction when detecting the motor 11 is stalled. Further, referring to FIG. 6, the controlling member 14 comprises a detecting module 141 and a controlling module 142. The controlling module 142 is provided with, e.g., has stored in memory, a parameter threshold for indicating a stalling of the motor and the detecting module 141 detects the corresponding working parameter of the electrical wrench 10 and sends it to the controlling module 142. The controlling module 142 compares the working parameter with the parameter threshold so as to detect whether the motor 10 is stalled and to control the motor 10 to rotate in the opposite direction if the motor 10 is stalled. The principle lies in that if the motor is stalled, the output is blocked, and then the motor is controlled to rotate in the opposite direction. Since the transmission mechanism is configured with the idle travels, the motor driving the transmission mechanism in the opposite direction may cause an impacting action, and due to the single-direction driving function of the ratchet assembly, the impacting torque and the rotating torque are still loaded in the determined rotating direction of the ratchet assembly. If the stalling of the motor is continued, the above operation may be repeated to perform continuous impacting action.

Figure 7:
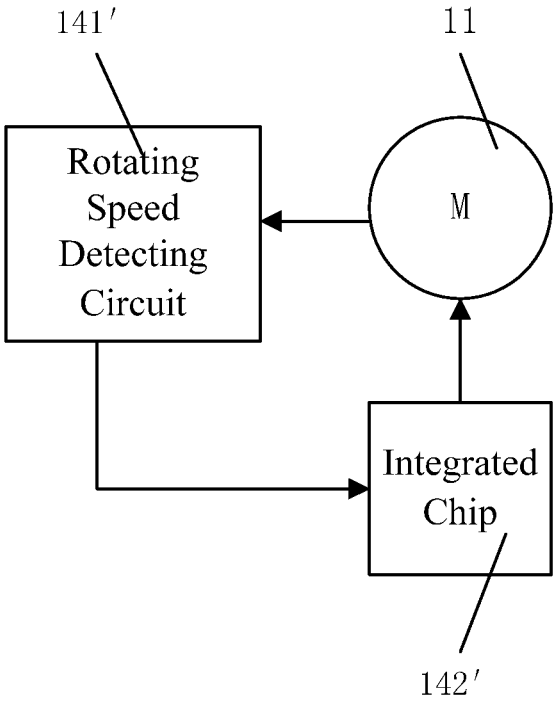
FIG. 7 is a block diagram of a further exemplary controlling member of the electrical wrench of FIG. 1.

When the motor rotates, the rotating magnetic field of the stator windings forces the rotor to rotate, and the magnetic field formed by the induced current in the rotor also induce a Back EMF from the stator windings, i.e., inductive reactance. The inductive reactance can prevent the current in the stator from increasing. When the output is blocked, the rotating speed of the motor is decreased, or even stalled, and the Back EMF will be reduced or even eliminated. At that moment, the motor has its resistance and inductance only. With the same voltage, the current flowing through the motor is increased greatly. After finishing the design of the mechanical structure of the tool, the current characteristic curve when the motor is stalled may be obtained by experimental measurements, thereby determining the current threshold indicating the stalling of the motor. Thus, during the operation of the tool, the working current flowing through the motor may be compared with the predetermined current threshold so as to determine whether the motor is stalled. One embodiment of the controlling member is designed in accordance with this principle and described as follows:

Referring to FIG. 7, the detecting module is a current detecting circuit 141', and the controlling module is an integrated chip 142'. The current detecting circuit 141' detects the working current flowing through the motor 11, and sends it to the integrated chip 142'. The integrated chip 142' compares the working current with the stored pre-measured current threshold for indicating the stalling of the motor 11. If the working current is equal to or larger than the current threshold, it is determined that the motor 11 is stalled, that is to say, the output of the electrical wrench 10 is blocked, and then the integrated chip 142' causes the current flowing through the motor 11 to reverse, thereby controlling the motor 11 to rotate in the opposite direction.

Figure 8:
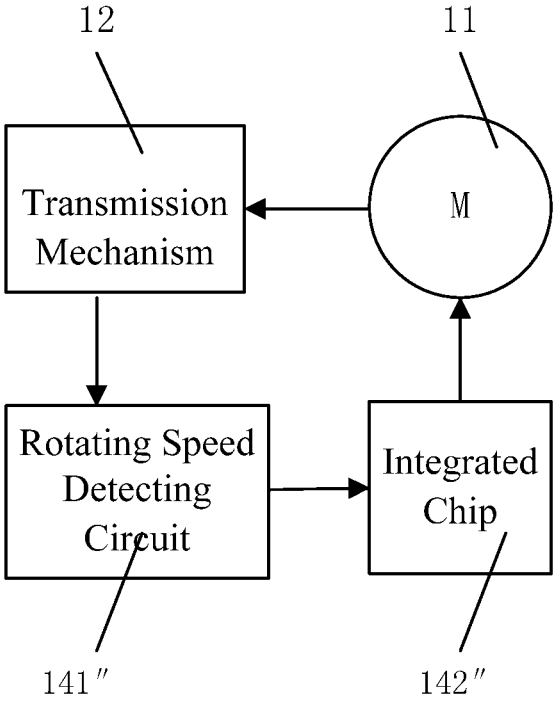
FIG. 8 is a block diagram of a still further exemplary controlling member of the electrical wrench of FIG. 1.

When the output is blocked, the rotating speed of the motor is decreased, or even the motor is stalled, and the rotating speed of the transmission mechanism varies accordingly, thus it may be determined that whether the output is stalled by directly measuring the rotating speed of the motor or indirectly measuring the rotating speed of the transmission mechanism. Since the rotating speed of the pivoting shaft of the motor is relatively high and the distance for the circumferential rotation is small while the rotating speed of the transmission mechanism is relatively low and the distance for the circumferential rotation is large, thus the stalling of the motor can be determined by the rotating speed of the transmission mechanism. A rotating speed threshold may be predetermined for the transmission mechanism, and the stalling or incoming stalling may be determined if the rotating speed is equal to or lower than the rotating speed threshold. Another embodiment of the controlling member may be designed in accordance with this principle and described as follows:

Referring to FIG. 8, the detecting module is a rotating speed detecting circuit 141", and the controlling module is an integrated chip 142". The rotating speed detecting circuit 141" detects the working rotating speed of the transmission mechanism 12, and sends it to the integrated chip 142". The integrated chip 142" compares the working rotating speed with the stored predetermined rotating speed threshold for indicating the stalling of the motor 11. If the working rotating speed is equal to or lower than the rotating speed threshold, it is determined that the motor 11 is stalled, that is to say, the output of the electrical wrench 10 is blocked, thus the integrated chip 142" causes the current flowing through the motor 11 to reverse, thereby controlling the motor 11 to rotate in the opposite direction.

It may be appreciated that the methods for detecting the stalling of the motor are not limited to the above embodiments, and the parameter threshold for indicating the stalling of the motor may also include other parameters that would be appreciated by those of skill in the art considering the disclosure herein. Such parameters may include, by way of example only, the voltage or the temperature.

Additionally, the electrical wrench 10 may be powered by an AC power supply or a DC power supply. In order to enhance the portability of the electrical wrench 10, the present invention preferably comprises a battery pack having multiple battery units as the DC power supply.

When the electrical wrench 10 is used to perform a fastening operation, it only needs to connect the ratchet assembly 13 of the electrical wrench 10 with the work piece, and then the switch is switched on. During the initial stage of the tightening operation and the later stage of the releasing operation, the resistance of rotating the work piece is relatively small, and then the controlling member 14 controls the ratchet assembly 13 to rotate continuously; and during the later stage of the tightening operation and the initial stage of the releasing operation, the resistance of rotating the work piece is relatively large, and it trends to cause a stalling, and the electrical wrench can cause the transmission mechanism 12 and the ratchet assembly 13 to output continuous impacting action corporately by electronic control, thereby releasing the work piece. Thus, the electrical wrench 10 of the present invention can achieve the function of the conventional impacting wrench by electrical control while simplifying the mechanical structure, which reduces the manufacturing cost of the tool and prolongs the working life of the tool.

The above examples are only used to explain the concept and principle of the present invention, rather than to limit the present invention. The person skilled in the art may appreciate that various replacements and modifications may be made to the present invention besides the above preferable embodiments, which are contained in the scope of the present invention. The protection scope of the present invention is thus to be determined by the attached claims alone.

What is claimed is:

1. An electrical wrench, comprising:

a motor, a transmission mechanism, a ratchet assembly and a controlling member wherein the motor, the transmission mechanism and the ratchet assembly are coupled to one another, wherein the transmission mechanism comprises a first transmission member and a second transmission member rotatably connected with each other, wherein the ratchet assembly comprises an eccentric shaft, a swinging member, a pawl and a ratchet, wherein the eccentric shaft is provided with a shaft projection deviating from the axis thereof, wherein the swinging member is configured to swing along with the rotation of the eccentric shaft and has an accommodating portion for accommodating the shaft projection, wherein the pawl is arranged on the swinging member and contacts ratchet teeth on the outer circumference of the ratchet, wherein the pawl is configured to drive the ratchet to rotate in a single direction along with the swinging of the swinging member, wherein the controlling member is used to control the rotation of the motor, wherein the first transmission member and the second transmission member are provided with idle travels separated from each other in the rotation direction, and wherein the controlling member comprises a detecting module for detecting whether the motor is stalled and a controlling module for controlling the motor to rotate in an opposite direction when it is detected that the motor is stalled.

2. The electrical wrench according to claim 1, wherein the controlling module is provided with a parameter threshold indicating the stalling of the motor, and the detecting module detects a corresponding working parameter of the electrical wrench and sends it to the controlling module, and then the controlling module is configured to detect the stalling of the motor and control the motor to rotate in the opposite direction by comparing the working parameter with the parameter threshold.

3. The electrical wrench according to claim 2, wherein the parameter threshold is a current threshold and the working parameter is a working current, the detecting module is used to detect the working current flowing through the motor and send it to the controlling module, and the controlling module is used to compare the working current with the current threshold and control the motor to rotate in the opposite direction when the working current is equal to or larger than the current threshold.

4. The electrical wrench according to claim 2, wherein the parameter threshold is a rotating speed threshold and the working parameter is a working rotating speed of the transmission mechanism, the detecting module is used to detect the working rotating speed of the transmission mechanism and send it to the controlling module, and the controlling module is used to compare the working rotating speed of the transmission mechanism with the rotating speed threshold and control the motor to rotate in the opposite direction when the rotating speed for working is equal to or lower than the rotating speed threshold.

5. The electrical wrench according to claim 1, wherein an end surface of the first transmission member facing the second transmission member is symmetrically provided with a pair of first bosses in the radial direction, and an end surface of the second transmission member facing the first transmission member is correspondingly provided with a pair of second bosses, the first bosses and the second bosses being configured to contact with each other along with the relative rotation of the first transmission member and the second transmission member.

6. The electrical wrench according to claim 5, wherein the transmission mechanism further comprises a gear speed-reducing member arranged between the first transmission member and the motor.

7. The electrical wrench according to claim 1, wherein an end surface of the first transmission member facing the second transmission member is asymmetrically provided with a first boss and a second boss in the radial direction, and an end surface of the second transmission member facing the first transmission member is correspondingly provided with a third boss and a fourth boss, the first boss being configured to only contact the third boss and the second boss being configured to only contact the fourth boss along with the relative rotation of the first transmission member and the second transmission member.

8. The electrical wrench according to claim 6, wherein the gear speed-reducing member is a planet gear speed-reducing mechanism or multistage gear speed-reducing mechanism.

9. The electrical wrench according to claim 1, wherein the pawl comprises a first pawl and a second pawl for alternatively contacting the ratchet, wherein when the first pawl in contact with the ratchet, the ratchet is rotated in the clockwise direction with a swinging of the swinging member, and when the second pawl is in contact with the ratchet, the ratchet is rotated in the anticlockwise direction with a swinging of the swinging member.

10. The electrical wrench according to claim 1, wherein the electrical wrench is be powered by at least one of an AC power supply or a DC power supply.

* * * * *